United States Patent [19]

Graham

[11] 4,211,177

[45] Jul. 8, 1980

[54] AUTOMATIC SLOW SPEED FOR SKIP STITCH MODE

[75] Inventor: Thomas G. Graham, Emerson, N.J.

[73] Assignee: The Singer Company, Stamford, Conn.

[21] Appl. No.: 34,794

[22] Filed: Apr. 30, 1979

[51] Int. Cl.[2] ..... D05B 3/02; D05B 69/18

[52] U.S. Cl. ..... 112/221

[58] Field of Search ..... 112/158 R, 221, 73, 112/220, 121.13, 277, 275

[56] References Cited

U.S. PATENT DOCUMENTS

| | | | |
|---|---|---|---|
| 3,559,601 | 2/1971 | Tullman | 112/158 R |
| 3,780,681 | 12/1973 | Sasaki | 112/275 |
| 3,913,507 | 10/1975 | Pollmeier | 112/153 |
| 4,137,860 | 2/1979 | Yoneji et al. | 112/275 X |
| 4,164,192 | 8/1979 | Herr et al. | 112/220 X |

*Primary Examiner*—Werner H. Schroeder
*Assistant Examiner*—Andrew M. Falik
*Attorney, Agent, or Firm*—James M. Trygg; Robert E. Smith; Edward L. Bell

[57] ABSTRACT

An automatic control means for overriding the manually operable fast/slow control switch of a sewing machine to assure slow speed operation while the machine is operating in skip stitch mode, such as while basting to facilitate positive latching and unlatching of the needle bar. The automatic control means cooperates with the needle bar lateral jogging mechanism of the sewing machine such that when the needle bar is jogged beyond a predetermined range of laterally jogged positions, wherein skip stitch mode is effected, the automatic control means will automatically impose slow speed operation independent of the setting of the fast/slow control switch as selected by the operator.

5 Claims, 5 Drawing Figures

AUTOMATIC SLOW SPEED FOR SKIP STITCH MODE

DESCRIPTION

BACKGROUND OF THE INVENTION

This invention relates to sewing machines having a mechanism permitting a skip stitch mode of operation. Such mechanisms have the capability of interrupting the reciprocating movement of the needle bar for a predetermined number of rotations of the main armshaft while the work feeding mechanism continues to operate. This mode of operation facilitates the sewing of repetitive but contiguous patterns including basting stitches. When interrupting the reciprocating movement of the needle bar, the needle bar drive link which is driven by the main arm shaft is decoupled from the needle bar which is then stored in a substantially full up position. This allows the needle bar drive link to continue to reciprocate and the work feeding mechanism to continue to operate until the needle bar drive link is again coupled to the needle bar for restoring reciprocatory motion thereto. The latching device that effects the coupling and decoupling of the needle bar drive link must do so in an extremely short time. Most such latching devices, when operated at the high speeds that are common in most modern household sewing machines, will occasionally fail to latch. This will cause the machine to skip stitch longer than it should, or to sew during part of the skip stitch cycle resulting in a non-uniform and aesthetically inferior work piece. The common solution to this problem is for the operator to activate a manually operable switch that selects a slow operating speed for the machine. However, should the operator fail to do so, the error may go unnoticed until significant damage is done to the workpiece.

The following cited patents, each deal in some way with automatic speed control of the sewing machine. U.S. Pat. No. 3,780,681, Dec. 25, 1973 by Sasaki discloses a sewing machine including a basting arrangement whereby the arm shaft is driven one revolution at a fixed slow speed independently of the amount of depression of the speed controller. U.S. Pat. No. 3,913,507, Oct. 21, 1975 by Pollmeier discloses a sewing machine having a workpiece cover element which is automatically displaced into an inoperative position when the machine is operated at low speed for precision stitching. Japanese Lay-Open 52-54551, May 4, 1977 by Watanabe et al discloses a sewing machine having a data store which holds the information for each pattern to be sewn. This information includes the maximum rotary speed permissible for each pattern.

The above citations comprise what the Applicant believes to be the closest disclosures that are relevant to the examination of this application.

SUMMARY OF THE INVENTION

The present invention overcomes these difficulties of the prior art by providing an automatic control means for overriding the speed controller and the manually operable fast/slow control switch of a sewing machine to assure slow speed operation while the machine is in skip stitch mode necessitating the rapid coupling and decoupling of the needle bar drive link.

It is therefore an objective of this invention to provide a control means which automatically selects a slow operating speed for the electric motor when the sewing machine is operating in skip stitch mode.

It is a further objective of this invention to assure proper and consistent operation of the latching device that effects the coupling and decoupling of the needle bar drive link.

Other objectives and advantages of the invention will become apparent through reference to the accompanying drawings and descriptive matter which illustrates a preferred embodiment of the invention.

According to the present invention, there is provided a sewing machine having a frame, stitch forming instrumentalities including a skip stitch mechanism having a needle bar supported for endwise reciprocation and for lateral jogging movement for the formation of zigzag stitches, means for influencing the lateral jogging movement of the needle bar beyond a predetermined range of laterally jogged positions, and interrupting means for the endwise reciprocation of the needle bar effective only during lateral jogging movement of the needle bar beyond the predetermined range. There is a drive shaft journalled in the frame for driving the stitch forming instrumentalities, a work feed mechanism actuated in timed relation with the drive shaft and an electric motor supported on the frame for rotatably driving the drive shaft. The motor is capable of operating at full rated speed when connected to a source of AC current and operating at a reduced speed when connected to a source of half wave rectified current. A half wave rectifier is connected in series with the armature circuit of the electric motor to effect the reduced speed operation. A first electric switch means connected in parallel with the half wave rectifier will provide a current path around the half wave rectifier when the switch is closed to effect operation of the electric motor at full rated speed. The improvement comprises:

a. sensing means responsive to the lateral position of the needle bar for determining that the lateral jogging movement of the needle bar is beyond its predetermined range, and b. override means responsive to the sensing means for overriding the effect of the first electric switch means and effecting reduced speed operation of the motor when lateral jogging movement of the needle bar is beyond the predetermined range.

BRIEF DESCRIPTION OF THE DRAWINGS

In order that the invention may be more fully understood, it will now be described, by way of example, with reference to the accompanying drawings in which.

PREFERRED EMBODIMENT OF THE INVENTION

Figure 1:
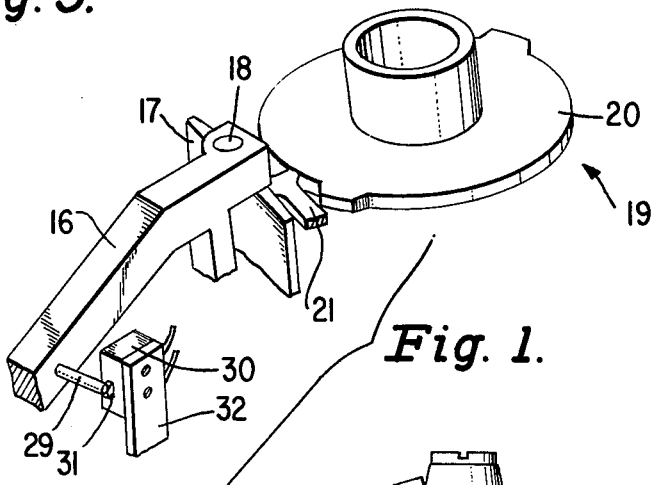
FIG. 1 is a perspective view of the needle bar assembly and related skip stitch and jogging mechanisms showing the needle bar held in the elevated skip stitch position.

Referring to FIG. 1, journalled for swinging movement on a vertical pin 1 is a needle bar gate 2 supporting a first spherical bearing 3 for an endwise reciprocatory needle bar 4. A second spherical bearing 5 is supported such that in addition to endwise reciprocation the needle bar can be jogged laterally for the formation of zigzag stitches. A needle bar drive link 6, driven by an electric motor 37 through a main drive shaft (not shown), imparts endwise reciprocation to the needle bar 4. The needle bar drive link 6 embraces a stud 7 which is sustained on the needle bar by a block 8 provided with cheek pieces 9. The block 8 is freely slidable lengthwise on the needle bar 4. Above the block 8 a collar 10 is securely fastened to the needle bar by a set screw. Pivoted to the collar 10 by a shoulder screw 11 is a latch lever 12 having on one end an upstanding finger 13 and formed on its opposite end a lateral latch finger 14, shown in FIG. 1, adapted to engage beneath a latch notch 15 formed in the cheek piece 9 of block 8 so as to secure the block 8 and the collar 10 together and thus complete an endwise reciprocatory needle bar driving connection between the needle bar 4 and the drive link 6.

Lateral jogging motion is imparted to the needle bar, as for zigzag sewing, by means of a zigzag drive link 16 which is pivotally connected to the needle bar gate 2 and has an integrating plate 17 pivoted thereon at 18 remote from the needle bar gate and adjacent to the cam stack, shown at 19, for sensing and transmitting needle jogging motion imparted to the cam follower 21 from the pattern cam 20.

Figure 3:
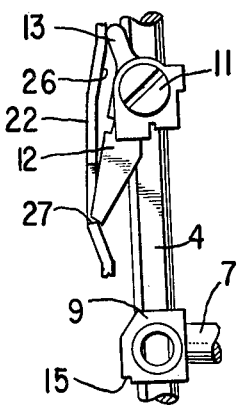
FIG. 3 is a front elevation view of a portion of the needle bar reciprocation interrupting means of FIG. 1 showing the latch means on the needle bar disengaged from the needle bar reciprocating drive means and locked substantially at the top of its stroke.
Figure 2:
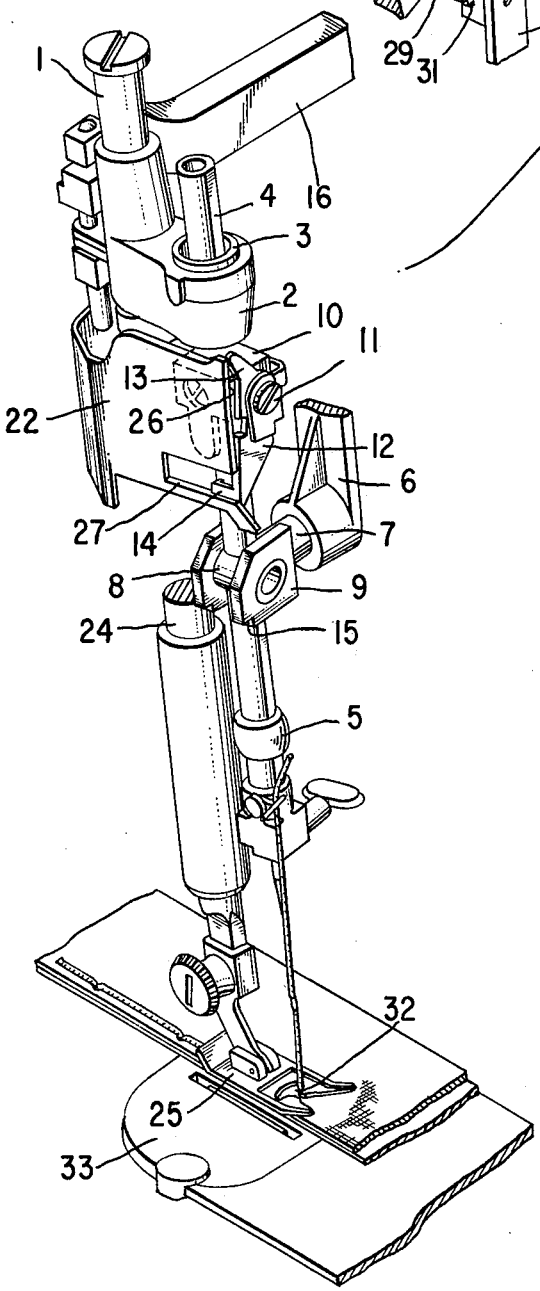
FIG. 2 is a front elevation view of the sewing head portion of the sewing machine illustrating the needle bar reciprocation interrupting means.
Figure 2:
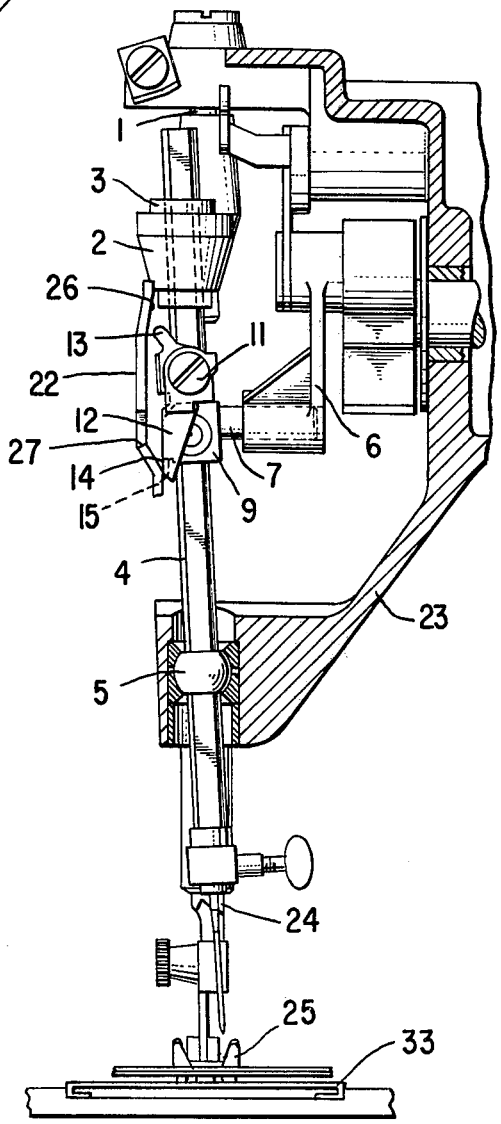

Referring to FIGS. 1, 2 and 3, bracket 22 is conventionally supported within the sewing head 23 for supporting an adjusting mechanism (not shown) for adjusting the downward spring pressure which is applied to a presser bar 24 slidably supported in the sewing head 23 and carrying at its lower extremity a conventional presser foot 25. The bracket 22 may be formed with a sloping abutment surface 26 which is positioned for engagement with the upstanding finger 13 of the latch lever 12 at the upstroke of the needle bar reciprocation whenever the needle bar is jogged beyond the range of laterally jogged positions which define the lateral operating limits of the stitch sewing mechanism. With reference to FIG. 1 it will be noted that the presser foot 25 is formed with a laterally elongated opening 32 for needle penetration. The presser foot needle aperture 32 conventionally corresponds in width with a needle aperture (not shown) formed in a throat plate 33 on which work is supported on the sewing machine. The needle apertures are formed sufficiently wide to accommodate the widest bight for lateral jogging movement which the needle is capable of making commensurate with the ability of the sewing instrumentalities to make a stitch. This defines the term "operating limits" of the stitch sewing mechanism as used herein.

As the needle bar is jogged beyond these operating limits by the zigzag drive link 16, the upstanding finger 13 of the latch lever 12 comes into pressing contact with the sloping abutment surface 26 causing the latch lever 12 to pivot in a clockwise direction as viewed in FIG. 3 until the lower end of the latch lever 12 engages a shoulder portion 27 of the bracket 22. Simultaneously, the lateral latch finger 14 of the latch lever 12 disengages from latch notch 15, thereby releasing the drive coupling between the block 30 and the needle bar 4 while locking the needle bar in its full up position. The block 8 being freely slidable on the needle bar 4 and driven by the needle bar drive link will continue to reciprocate while the needle bar is so locked. This operating state is defined as skip stitch mode as used herein. As the zigzag drive link 16 jogs the needle bar 4 back within the range of operating limits, the upstanding finger 13 disengages from the sloping abutment surface 26 permitting the latch lever 12 to pivot in a counterclockwise direction, as viewed in FIG. 3, under the urging of a spring bias and thereby the latral latch finger 14 latchingly engages the latch notch 15 of the cheek piece 9 completing the driving connection between the needle bar 4 and the drive link 6. This mechanism for effecting sewing machine operation in skip stitch mode is more fully described in U.S. Pat. No. 3,559,601, Feb. 2, 1971 by Tullman, the disclosure of which is incorporated herein by reference.

Figure 4:
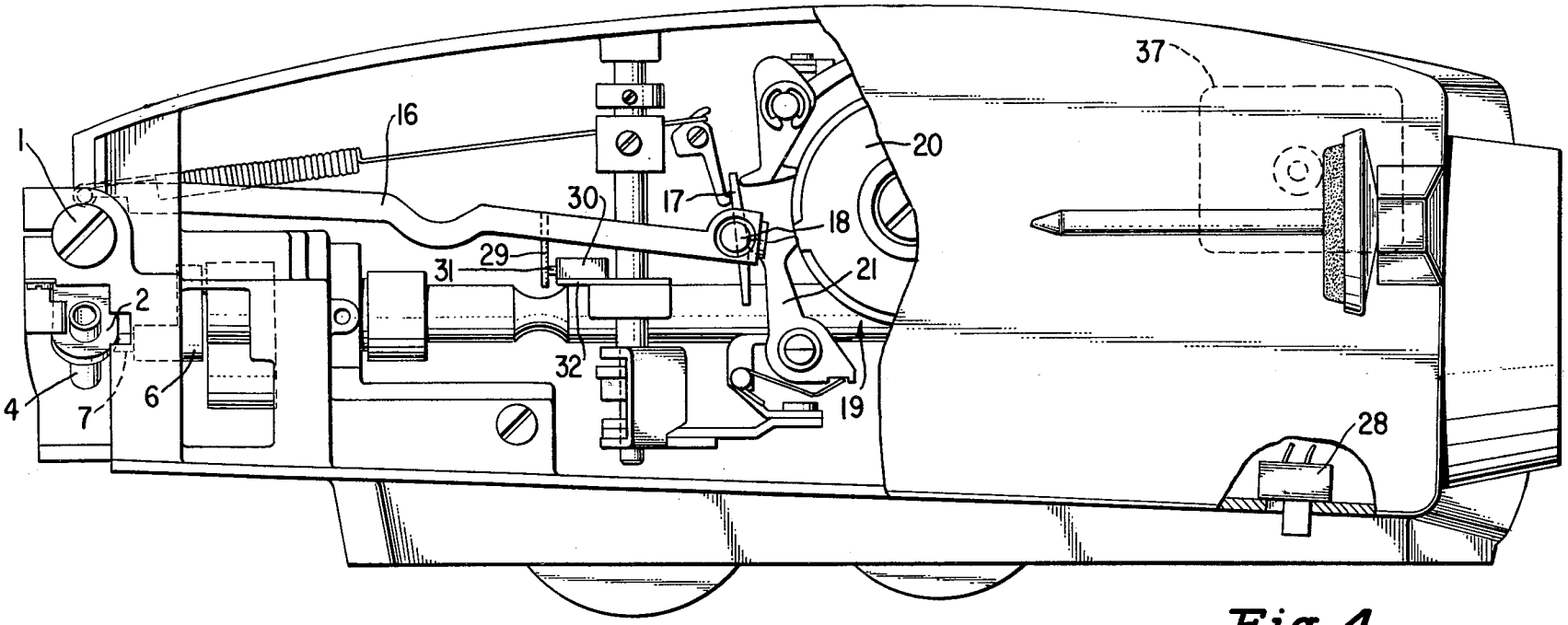
FIG. 4 is a top plan view of a sewing machine with a portion of the top cover plate removed showing a portion of the skip stitch mechanism as it relates to the automatic control means of this invention.

Referring to FIGS. 1 and 4, the actuating member 29, projecting from and in a direction normal to the direction of movement of zigzag drive link 16 is rigidly attached thereto. A first switch 28, mounted for easy access by the operator, as shown in FIG. 4, has at least two speed settings for controlling the maximum speed of the electric motor 37. A second switch 30 is attached to one extremity of a mounting bracket 32, the other extremity of which is rigidly attached to the machine's frame. The second switch 30 is positioned such that when the needle bar is jogged beyond its operating limits by the zigzag drive link 16 and the needle bar 4 is thereby decoupled from the drive link 6, actuating member 29 operationally engages the plunger 31 of the second switch 30 thereby actuating the switch.

Figure 5:
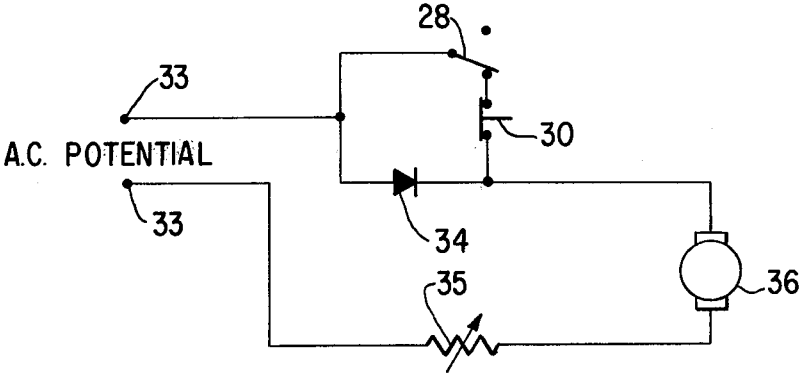
FIG. 5 is a circuit diagram illustrating the automatic control means of this invention in relation to the speed control circuit for the electric drive motor of the sewing machine.

As shown in the circuit diagram of FIG. 5 an AC potential is applied across two terminals 33 which are connected in series with a half wave rectifier 34, a motor armature circuit 36 of the electric motor 37, and a motor speed controller 35. The first switch 28 is connected in parallel with the half wave rectifier 34 such that when the first switch 28 is closed, it provides a current path around the half wave rectifier directly to the motor armature circuit 36. Second electric switch 30, which is normally closed, is connected in series with, and may be inserted on either side of, first electric switch 28.

In operation, the electric motor 37 is capable of operating at at least two different armature speeds. The motor will operate at its full rated speed when connected to a source of AC current and at a reduced speed when connected to a source of half wave rectified current. First electric switch 28, if closed by the operator, will provide a current path around the half wave rectifier and thereby effect full speed operation of the motor. If opened by the operator, it will require the current to flow through the half wave rectifier and thereby effect reduced speed operation of the motor. When the needle bar 4 is jogged beyond its operating limits by the zigzag drive link 16, the actuating member 29 actuates second electric switch 30 electrically disconnecting one side of first electric switch 28 and thereby requiring the current to flow through the half wave rectifier 35 and effecting reduced speed operation of the electric motor 37. The reduced speed operation thus achieved is independent of the state of the first electric switch 28. The second electric switch thus acts as an override of the manually selectable fast or slow speed function of the first electric switch. Reduced speed operation of the electric motor 37 is thereby automatically selected and enabled whenever the needle bar 4 is jogged beyond its operating limits by the zigzag drive link 16 and the machine is thereby placed in skip stitch mode.

The present invention may be applied to any sewing machine equipped with a mechanism for effecting skip stitch mode operation. It will be appreciated that the actuating member 29 may be a pin or other projection, or the like, either attached to or formed as an integral part of the zigzag drive link 16. Depending to some degree on the configuration of the second electric switch 30, the actuating member 29 may take a somewhat different form. For instance, the second electric switch 30 could be a Hall effect device in which case the actuating member 29 would be a coil of wire or simply a ferrous mass. Similarly, it is considered within the scope of this invention that second electric switch 30 could be of the photoelectric type wherein the actuating member 29 would be a light source or a reflective spot. It will be understood that the various changes in the details, materials and arrangement of the parts as described above are not intended to limit the scope of this invention and that other similar changes may be made by those skilled in the art, within the principles and scope of this invention.

I claim:

1. A sewing machine having a frame, stitch forming instrumentalities including a skip stitch mechanism having a needle bar supported for endwise reciprocation and for lateral jogging movement for the formation of zigzag stitches, pitman means for influencing the lateral jogging movement of said needle bar beyond a predetermined range of laterally jogged positions, and interrupting means for said endwise reciprocation of said needle bar effective only during lateral jogging movement of said needle bar beyond said predetermined range, a drive shaft journalled in said frame for driving said stitch forming instrumentalities, a work feed mechanism actuated in timed relation with said drive shaft, an electric motor supported on said frame for rotatably driving said drive shaft, said motor capable of operating at full rated speed when connected to a source of AC current and operating at a reduced speed when connected to a source of half wave rectified current, a half wave rectifier connected in series with the armature circuit of said electric motor to effect said reduced speed operation of said motor and a first electric switch means connected in parallel with said half wave rectifier for providing a current path around said half wave rectifier when said switch is closed to effect operation of said electric motor at full rated speed, wherein the improvement comprises:

a. sensing means responsive to the lateral position of said needle bar for determining that said lateral jogging movement of said needle bar is beyond said predetermined range, and b. override means responsive to said sensing means for overriding the effect of said first electric switch means and effecting said reduced speed operation of said motor when said lateral jogging movement of said needle bar is beyond said predetermined range.

2. A sewing machine as recited in claim 1 wherein said override means is a second electric switch means connected in series with said first electric switch means for opening a circuit thereby causing said AC current to flow through said half wave rectifier in said armature circuit.

3. A sewing machine as recited in claim 2 wherein said second electric switch means is an electric switch of the momentary depression normally closed type.

4. A sewing machine as recited in claim 2 or claim 3 wherein said sensing means is an actuating means for automatically actuating said second electric switch means when said lateral jogging movement of said needle bar is beyond said predetermined range.

5. A sewing machine as recited in claim 2 or claim 3 wherein said sensing means comprises an actuating member projecting from and normal to the direction of motion of said pitman means and positioned such that it automatically actuates said second electric switch means when said lateral jogging movement of said needle bar is beyond said predetermined range.

* * * * *